US006764342B2

(12) United States Patent
Murayama et al.

(10) Patent No.: US 6,764,342 B2
(45) Date of Patent: Jul. 20, 2004

(54) ELECTRICAL CONNECTOR FOR BALANCED TRANSMISSION CABLES WITH MODULE FOR POSITIONING CABLES

(75) Inventors: Ryusuke Murayama, Koganei (JP); Shigeyuki Maruhashi, Mitaka (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/607,689

(22) Filed: Jun. 27, 2003

(65) Prior Publication Data

US 2004/0002262 A1 Jan. 1, 2004

(30) Foreign Application Priority Data

Jun. 28, 2002 (JP) ..... 2002-189223

(51) Int. Cl.[7] ..... H01R 13/648

(52) U.S. Cl. ..... 439/608; 439/701; 439/108; 439/733.1

(58) Field of Search ..... 439/607–610, 439/98, 701, 108, 497–499, 696, 731, 687, 941, 733.1, 626, 658

(56) References Cited

U.S. PATENT DOCUMENTS 3,587,028 A * 6/1971 Uberbacher ..... 439/49
5,085,596 A * 2/1992 Bowen et al. ..... 439/497
5,176,538 A * 1/1993 Hansell et al. ..... 439/607
5,620,340 A * 4/1997 Andrews ..... 439/608
6,478,624 B2 * 11/2002 Ramey et al. ..... 439/608
6,482,028 B2 * 11/2002 Kumamoto et al. ..... 439/498
6,619,987 B2 * 9/2003 Kumamoto et al. ..... 439/610
6,685,511 B2 * 2/2004 Akama et al. ..... 439/610

FOREIGN PATENT DOCUMENTS

JP 2000-68007 3/2000

* cited by examiner

*Primary Examiner*—Gary Paumen
*Assistant Examiner*—Edwin A. Leon
(74) *Attorney, Agent, or Firm*—Michael Best & Friedrich LLP

(57) ABSTRACT

A first insulator (20) is combined with a connector body 50 comprising a second insulator (60), signal contacts (80) and ground contacts (70). The first insulator (20) is provided with separator accommodation slits (22); and cable receiving portions (24). Each cable receiving portion (24) is arranged between the respective neighboring separator accommodation slits (22) and is able to hold one of the balanced transmission cables (200). Separators (90) connected to ground contacts (70) are fitted within the separator accommodation slits (22) so that end portions of balanced transmission cables (200) are positioned between the respective neighboring separators (90) and are electrically shielded by them. The first insulator (20) holds ground plates (30) so that each of the cable receiving portions (24) is also arranged between the ground plates (30). The separators (90) and the ground plates (30) define tubular enclosures for surrounding end portions of the respective balanced transmission cables.

8 Claims, 10 Drawing Sheets

ELECTRICAL CONNECTOR FOR BALANCED TRANSMISSION CABLES WITH MODULE FOR POSITIONING CABLES

The present application claims priority to prior patent application JP 2002-189223, the disclosure of which is incorporated herein by reference.

BACKGROUND OF THE INVENTION

The present invention relates to a cable connector which is able to be connected to a plurality of balanced transmission cables.

The balanced transmission cable comprises a pair of signal conductors, an insulating member and an electrical shield such as a braided metal shield. The signal conductors constituting one pair are insulated from each other by the insulating member. The electrical shield surrounds the insulating member and serves as common ground to the pair of signal conductors when being electrically connected to a ground point of an objective circuit.

JP-A 2000-68007 discloses a cable connector which is able to be connected to the balanced transmission cables. Usually, a plurality of balanced transmission cables are equi-angularly spaced around an central insulator core and are sheathed in an outer insulator jacket to form a cable assembly. The cable connector comprises a plurality of signal contacts, a plurality of ground contacts, and a supplementary substrate. On the supplementary substrate, a plurality of signal pads, a plurality of ground pads and two ground lands are formed. The signal pads are connected to the respective signal contacts, while the ground pads are connected to the respective ground contacts. The ground contacts are grouped into two groups, each of which is also connected to the corresponding ground land. When the balanced transmission cables are connected to the cable connector, they are separated to each other by skinning off the jacket and the electrical shields of the cables are soldered on the respective ground land. The paired signal conductors of each cable are separated by removing the braided metal shield, exposed by skinning off the insulator therebetween and soldered on the respective signal pads.

In the cable connector disclosed in JP-A 2000-68007, each of cables and each of signal conductors are not always soldered at fixed positions on the ground land and the signal pads. Further, they are left loose except portions soldered to the ground land the signal pads. Therefore, the cables and signal conductors are changed in distance between them, which results in undesired change in the electrical transmission properties. Further, signal conductors of different balanced transmission cables are not shielded to each other by removing the braided metal shields so that cross-talk is often caused.

SUMMARY OF THE INVENTION

It is therefore an object of the present invention to provide a cable connector which can resolve the problems described above.

This invention is applicable to a cable connector connectable to at least two balanced transmission cables each of which comprises a pair of signal conductors insulated from each other, and an electrical shield electrically insulated from and surrounding the pair of signal conductors. According to this invention, the cable connector comprises a first module and a second module which is combined with the first module. The first module comprises a first insulator and a ground portion electrically connectable to the electrical shields. The first insulator holds the ground portion and is provided with separator accommodation slits. The first insulator is further provided with cable receiving portions each of which is arranged between the respective neighboring separator accommodation slits and is able to hold one of the balanced transmission cables. The second module comprises at least two pairs of signal contacts connectable to the respective pairs of the signal conductors, ground contacts insulated from the signal contacts, separators physically and electrically connected to the ground contacts, and a second insulator holding the ground contacts and the signal contacts. The separators project from the second insulator. Under a combined state of the first and the second modules, the separators are fitted into the respective separator accommodation slits and are electrically connected to the ground portion.

According to an aspect, the first insulator has a first front end and a first rear end in a first direction. Each of the cable receiving portions extends in the first direction from the first rear end towards the first front end and is provided with a pair of positioning holes which are formed in the first front end and serve to position the corresponding pair of signal conductors. The signal contacts are arranged in correspondence with the respective positioning holes.

According to another aspect, the ground portion is comprised of at least two ground plates spaced from each other. Each of the separator accommodation slits is laid on a plane intersecting the ground plates, and each of the cable receiving portions is arranged between the ground plates. Under the combined state, the separators and the ground plates define enclosures for surrounding end portions of the respective balanced transmission cables.

According to another aspect, each of the pairs of the positioning holes are arranged on one and the same imaginary plane extending in the first and the third directions. The signal contacts constituting one pair are arranged in line with the third direction and each pair of the signal contacts is arranged between two pairs of the ground contacts in the second direction.

Further objects, features and advantages of the present invention are comprehensible from the following description of embodiments of the invention in connection with figures attached hereto.

DESCRIPTION OF PREFERRED EMBODIMENTS

Figure 1:
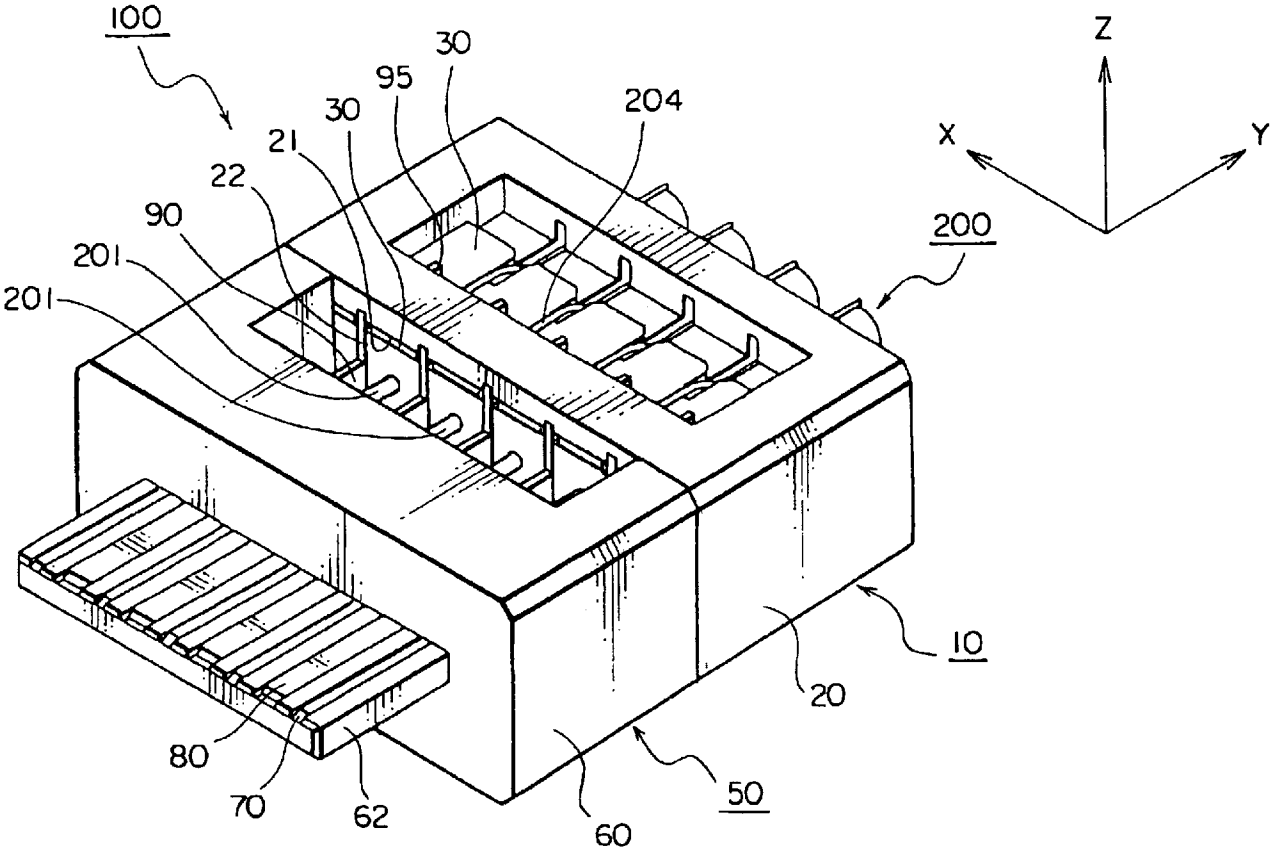
FIG. 1 is a perspective view showing a cable connector according to an embodiment of the present invention.

With reference to FIG. 1, a cable connector 100 according to an embodiment of the present invention comprises a combination of first and second modules 10, 50. The cable connector 100 may further comprise a metallic shell surrounding the first and the second modules 10, 50.

Figure 4:
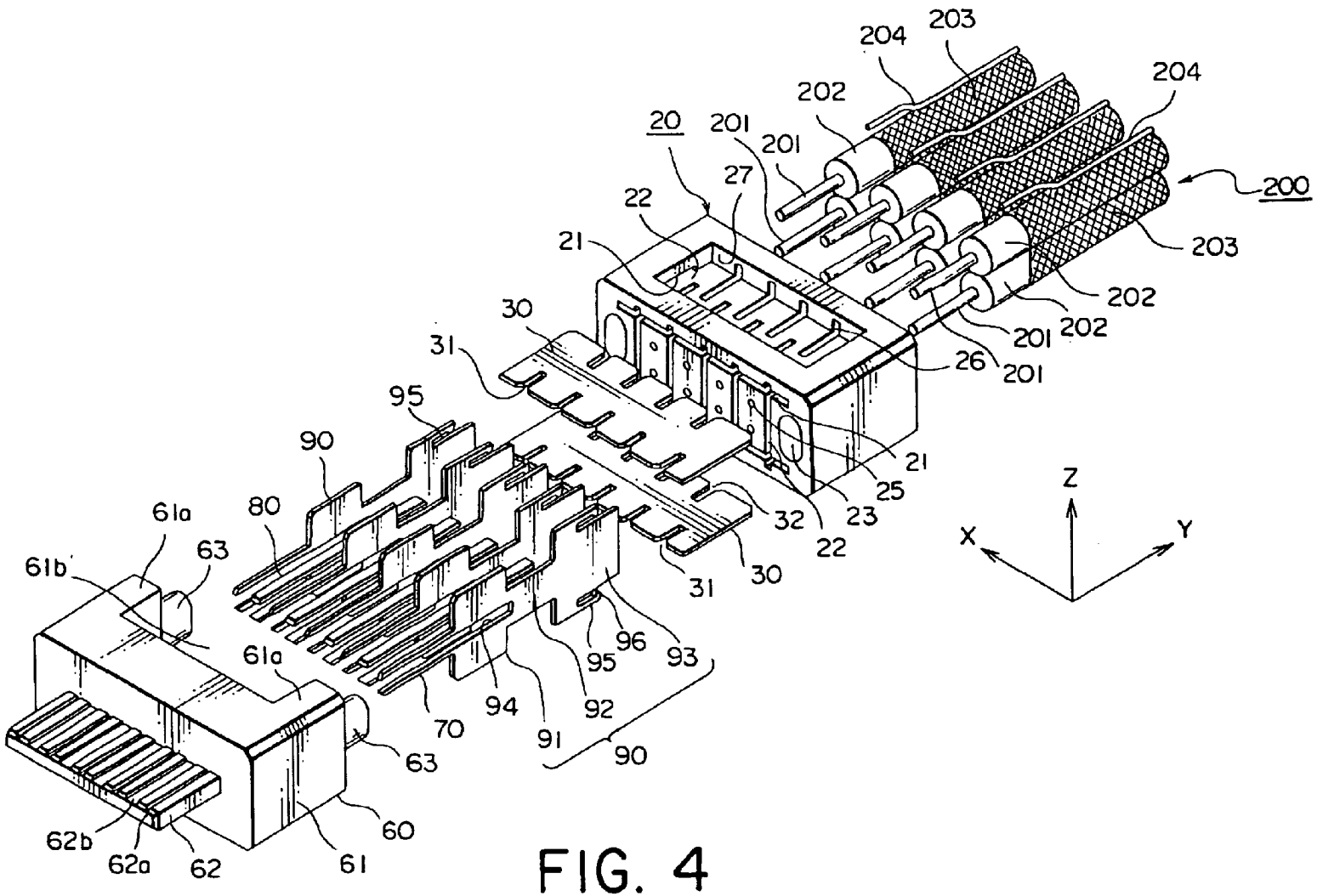
FIG. 4 is an exploded, perspective view showing the cable connector of FIG. 1.
Figure 13:
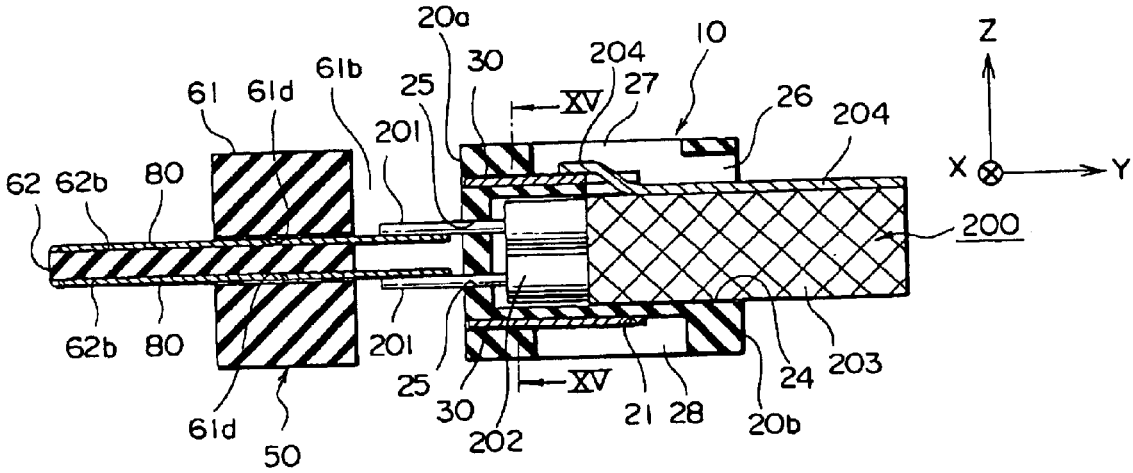
FIG. 13 is a cross-sectional view of the cable connector taken along lines XIII—XIII of FIG. 8, wherein some parts are omitted for the sake of better understanding.

The cable connector 100 is able to be connected to two or more balanced transmission cables 200. Each balanced transmission cable 200 comprises a pair of signal conductors 201, an insulating member 202 insulating the signal conductors 201 from each other, a braided electrical shield 203 surrounding the insulating member 202 and a drain wire 204 connected to the braided electrical shield 203, as shown in FIGS. 4 and 13. Normally, the balanced transmission cable 200 further comprises an outer sheath surrounding the braided electrical shield 203, or a plurality of balanced transmission cables 200 are equi-angularly spaced around an insulating center core and surrounded together by an outer insulating jacket, but the outer sheath or the outer jacket is not shown in the drawings.

Figure 2:
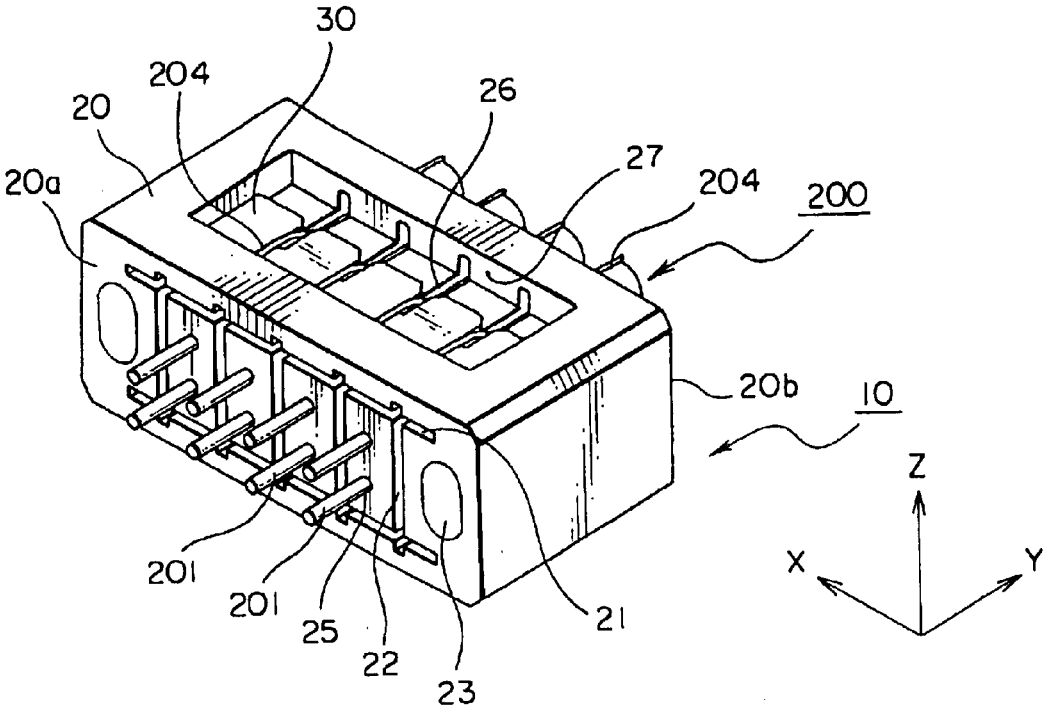
FIG. 2 is a perspective view showing a first module included in the cable connector of FIG. 1.
Figure 15:
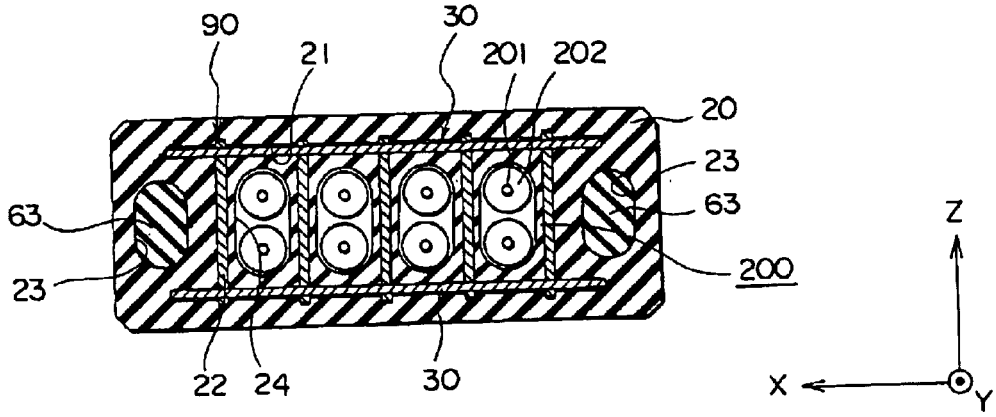
FIG. 15 is a cross-sectional view of the cable connector taken along lines XV—XV of FIG. 13.

The first module 10 comprises a first insulator 20, which has a first front end 20*a* and a first rear end 20*b* opposite to the first front end 20*a* in a Y-direction, as shown in FIGS. 2, 4 and 15. In the first insulator 20, two plate accommodation slits 21 are formed. Each of the plate accommodation slits 21 is laid on a plain defined by the Y-direction and an X-direction perpendicular to the Y-direction.

Figure 10:
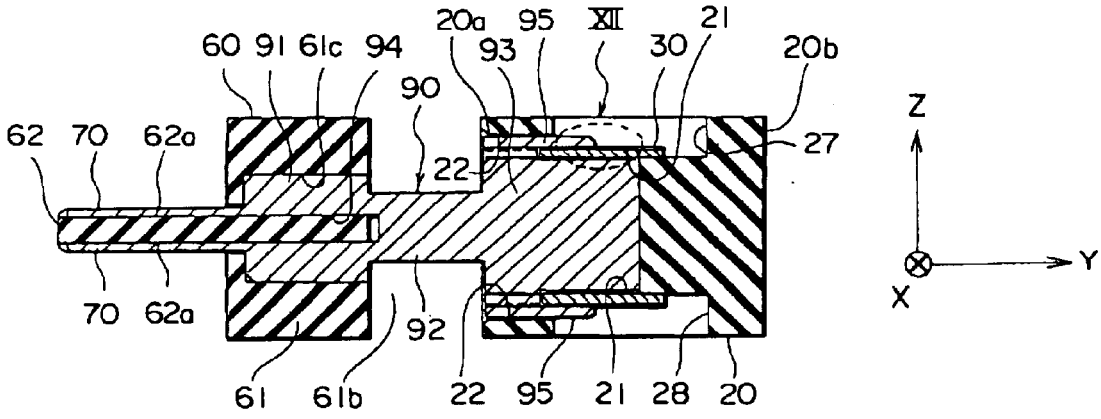
FIG. 10 is a cross-sectional view of the cable connector taken along lines X—X of FIG. 8, wherein some parts are omitted for the sake of better understanding.

The plate accommodation slits 21 hold ground plates 30, respectively, as shown in FIGS. 4, 10, and 15. The ground plates 30 extend in the X-direction but do not reach the opposite sides of the first insulator 20 in the X-direction. The ground plates 30 also extend in the Y-direction from the first front end 20*a* toward the first rear end 20*b* but do not reach the first rear end 20*b*, as shown in FIGS. 10 and 13. The ground plates 30 are spaced from each other in a Z-direction perpendicular to the X- and the Y-directions. The plate accommodation slits 21 are sized to suitably accommodate the above-mentioned ground plates 30.

Each of the ground plates 30 are formed with engaging incisions 31 and wire receiving incisions 32, as shown in FIG. 4. The number of the engaging incisions 31 is five. The number of the wire receiving incisions 32 is four and is smaller than that of the engaging incisions 31 by one. The engaging incisions 31 extend in the Y-direction from a front edge of the ground plate 30 towards a rear edge of the ground plate 30 and are parallel to each other. The wire receiving portions 32 extend in the Y-direction from the rear edge of the ground plate 30 towards the front edge of the ground plate 30 and are parallel to each other. The engaging incisions 31 and the wire receiving incisions 32 do not overlap with each other in the Y-direction. The engaging incisions 31 and the wire receiving incisions 32 are arranged alternately in the X-direction so that the each of the wire receiving incisions 32 is positioned between the respective neighboring ones of the engaging incisions 31 in the X-direction. The function of the wire receiving incision 32 is described afterwards.

Figure 11:
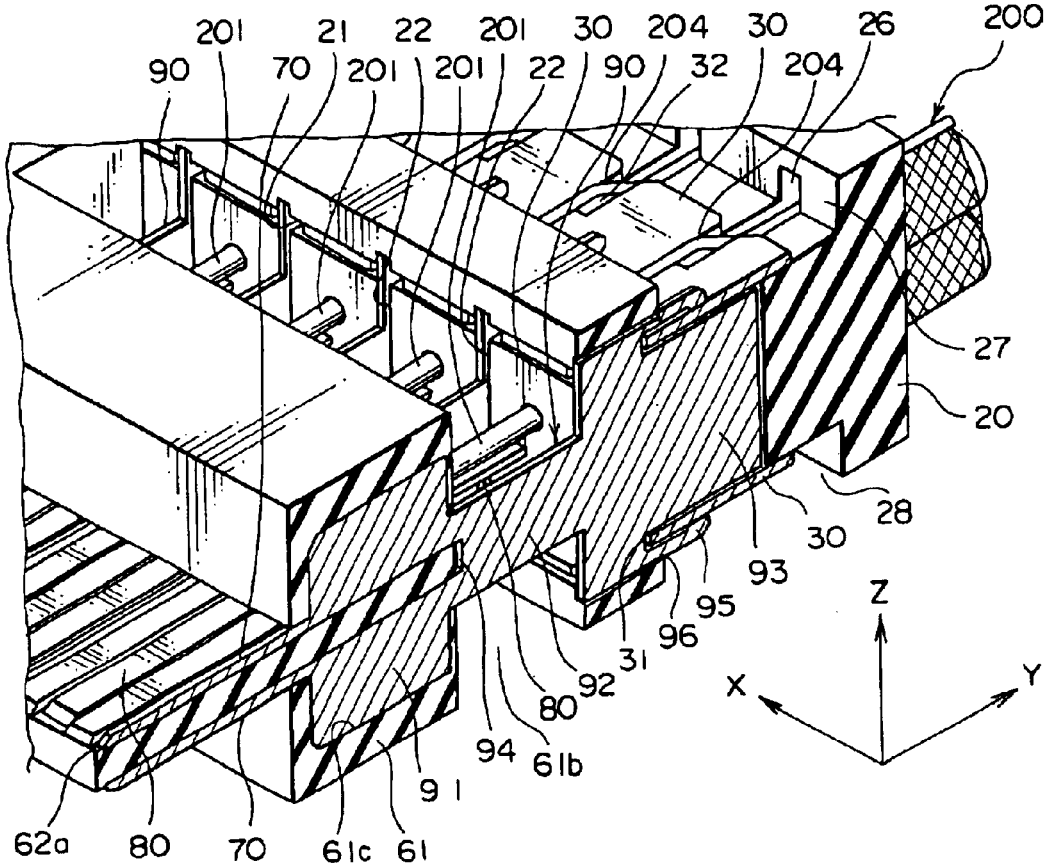
FIG. 11 is a perspective view of the cable connector partially cut away along lines XI—XI of FIG. 8.
Figure 14:
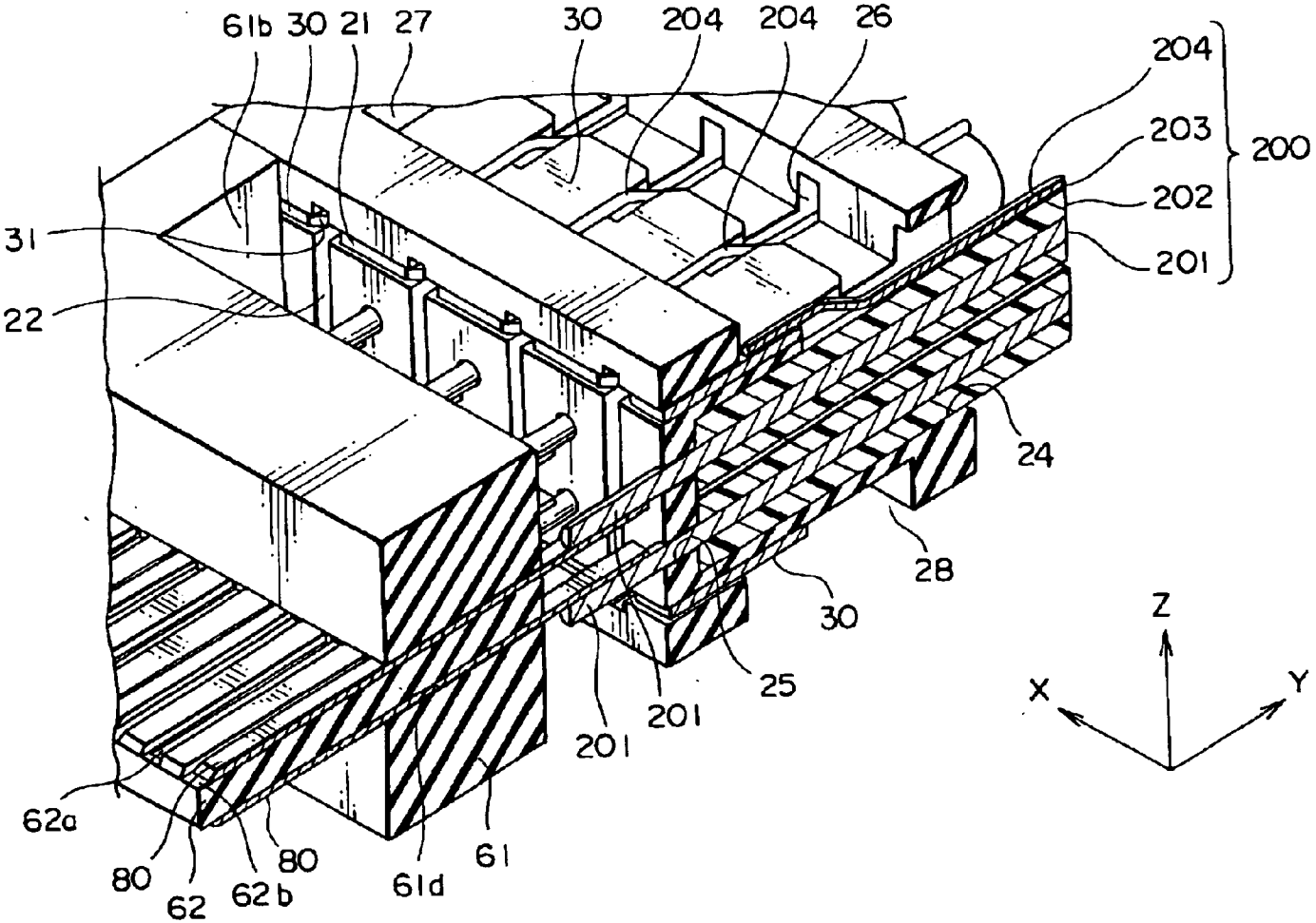
FIG. 14 is a perspective view of the cable connector partially cut away along lines XIV—XIV of FIG. 8, wherein some parts are omitted for the sake of better understanding.

As shown in FIGS. 2 and 15, the first insulator 20 is formed with five separator accommodation slits 22. The separator accommodation slits 22 are laid on planes each perpendicular to the X-direction and intersect the ground plates 30 held by the plate accommodation slits 21. In detail, the separator accommodation slits 22 extend in the Z-direction but do not reach the upper and the lower surfaces of the first insulator 20 in the Z-direction. The separator accommodation slits 22 also extend from the first front end 20*a* towards the first rear end 20*b* in the Y-direction but do not reach the first rear end 20*b*, as shown in FIGS. 10 and 11. The separator accommodation slits 22 are arranged in the X-direction, as shown in FIGS. 4 and 15. The positions of the separator accommodation slits 22 in the X-direction correspond to the respective engaging incisions 31 of the ground plates 30, as can be seen in FIG. 14.

Figure 3:
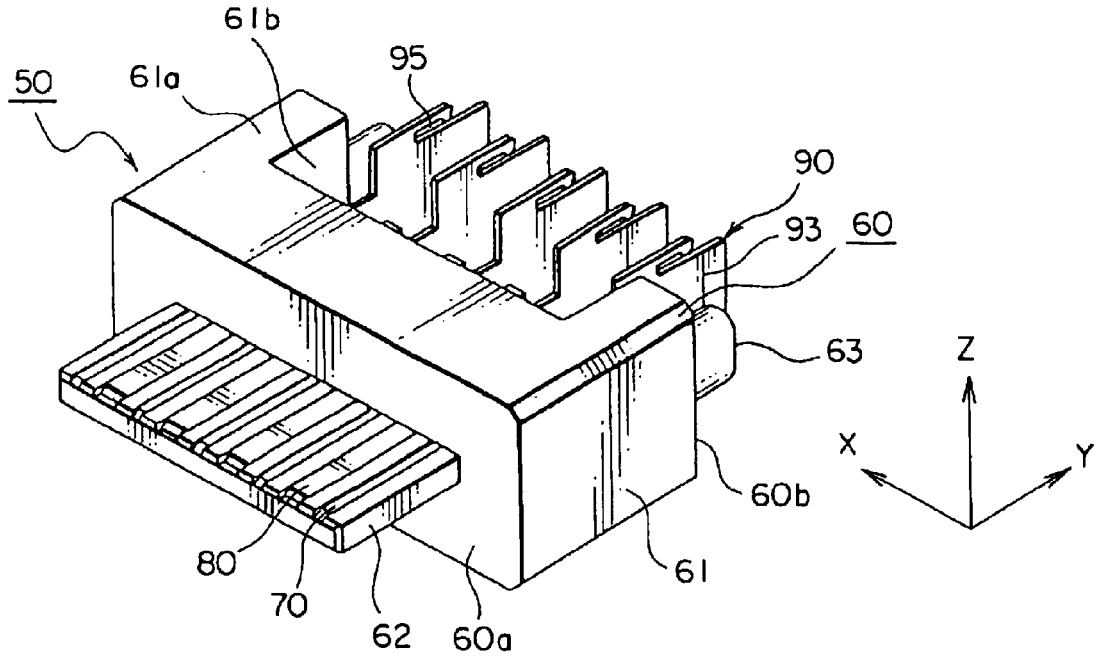
FIG. 3 is a perspective view showing a second module included in the cable connector of FIG. 1.

In the first front end 20*a* of the first insulator 20, two holes 23 are also formed, as shown in FIGS. 2 and 3. Into the holes 23, portions of the second module 50 are fitted, which will be described afterwards.

Figure 9:
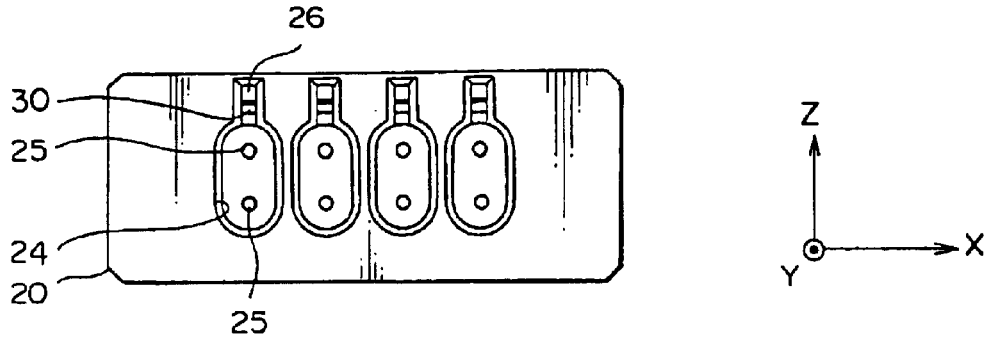
FIG. 9 is a rear view showing the cable connector of FIG. 1.

In the first rear end 20*b*, four cable receiving portions 24 are formed as shown in FIG. 9. The cable receiving portions 24 serve to receive the respective balanced transmission cable 200 to be inserted from the first rear end 20*b* of the first insulator 20. Each of the cable receiving portions 24 is a straight hole, which extends in the Y-direction in parallel and has a cross-section of an elongated circle or an ellipse in the XZ plane, as shown in FIGS. 9, 13, and 15. The longitudinal direction of the cross-section of the cable receiving portion 24 is the Z-direction so that, when the balanced transmission cable 200 is received by the cable receiving portion 24, the signal conductors 201 constituting one pair are arranged in line with the Z-direction, as shown in FIG. 15. In addition, the cable receiving portions 24 are arranged along the X-direction so that, when the balanced transmission cables 200 are inserted into the cable receiving portions 24, the balanced transmission cables 200 are arranged also along the X-direction.

Each of the cable receiving portions 24 is provided with a pair of positioning holes 25, as shown in FIGS. 9 and 13. The positioning holes 25 extend from the first front end 20*a* to the corresponding cable receiving portion 24. In other words, the positioning holes 25 are formed in the first front end 20*a* and penetrate it. The positioning holes 25 constituting one pair are positioned on one and the same YZ plane, as shown in FIGS. 9 and 15. Each of the positioning holes 25 is sized to receive the corresponding signal conductor 201 and serves to position it.

Figure 5:
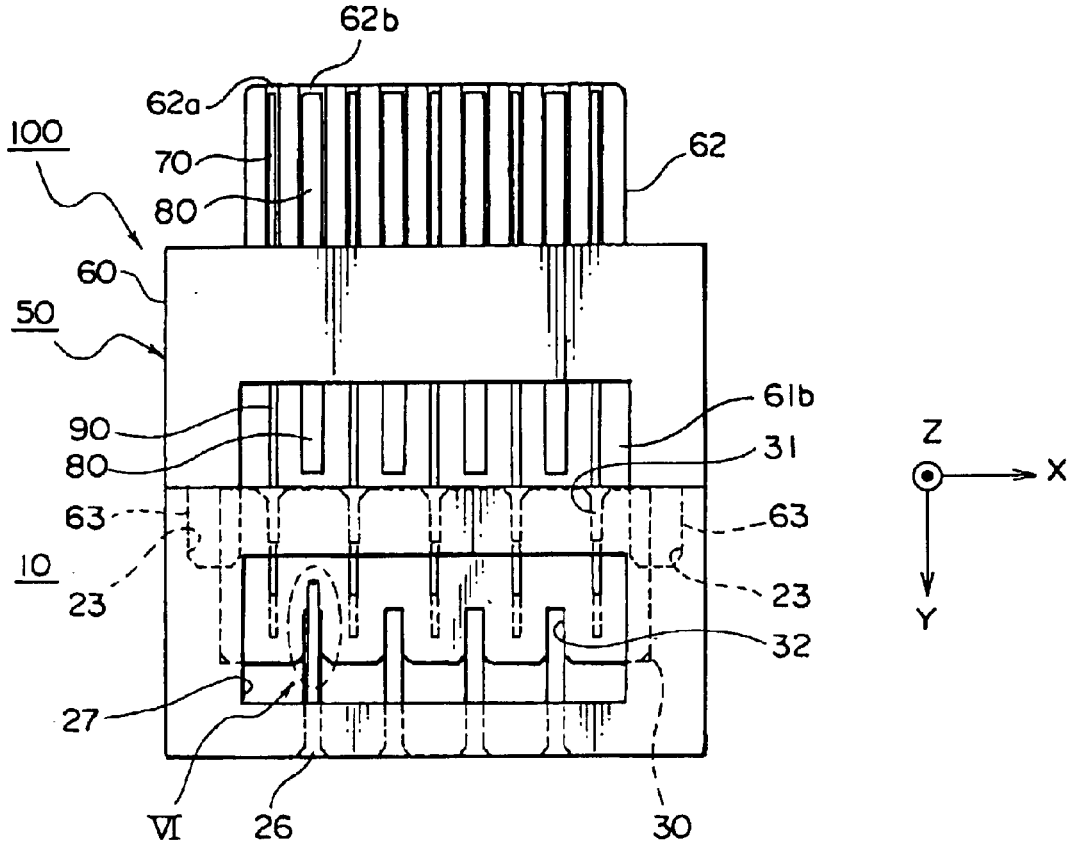
FIG. 5 is a top plan view showing the cable connector of FIG. 1.

The cable receiving potion 24 is also provided with a wire receiving portion 26, which serves to receive the drain wire 204, as shown in FIG. 13. The wire receiving portion 26 has a cross section of rectangular in the XZ plane, as shown in FIG. 9. The wire receiving portion 26 extends from the first rear end 20*b* towards the first front end 20*a* in the Y-direction but does not reach the first front end 20*a*. The positions of the wire receiving portions 26 in the X-direction correspond to that of the wire receiving incisions 32 of the ground plate 30, as shown in FIGS. 5 and 14.

Figure 6:
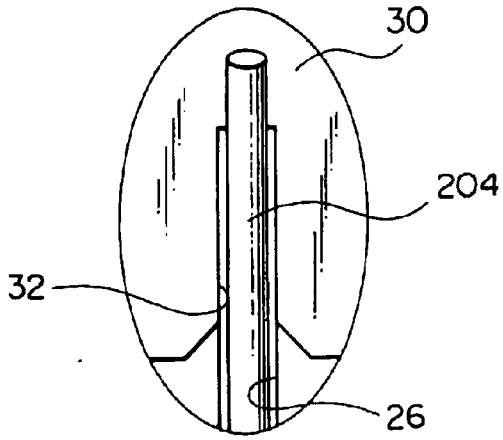
FIG. 6 is an enlarged view of a part of FIG. 5 which is indicated with a broken line VI.
Figure 7:
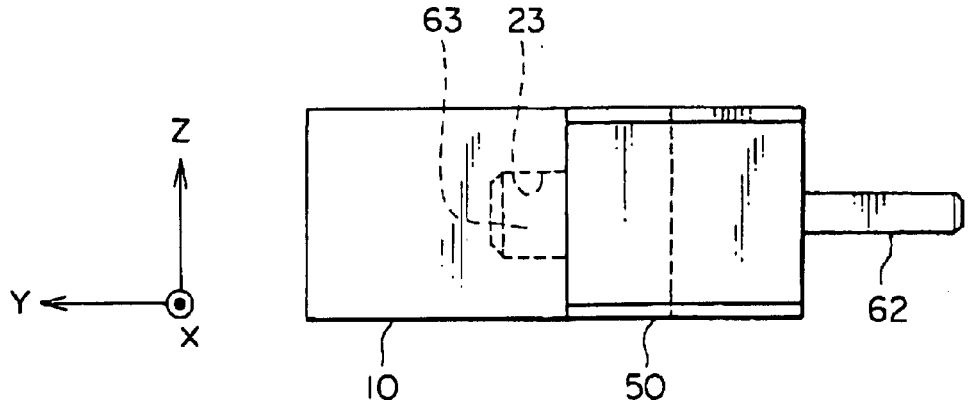
FIG. 7 is a side view showing the cable connector of FIG. 1.
Figure 16:
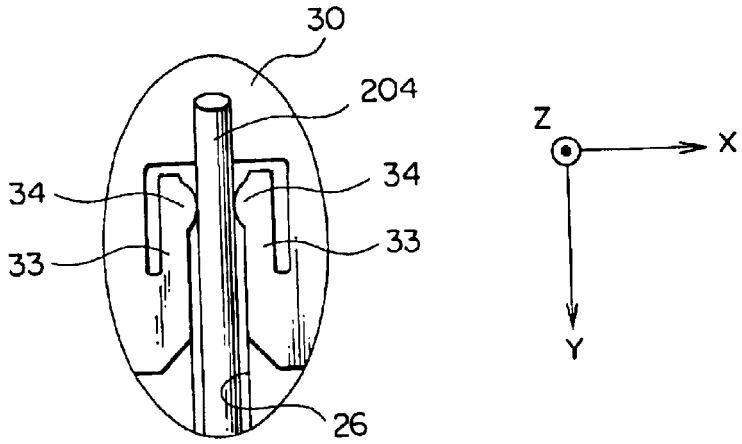
FIG. 16 is an enlarged view of a part of a modification of the cable connector, this figure corresponding to FIG. 6.

The wire receiving incisions 32 receive the respective drain wires 204 through the respective wire receiving portions 26, as shown in FIGS. 6, 11 and 14. In this embodiment, the drain wires 204 are soldered to the ground plate 30, after received by the wire receiving incisions 32. Alternatively, a mechanical fixation may be adopted as the connection between the ground plate 30 and the drain wires 204, as shown in FIG. 16. In FIG. 16, the ground plate 30 is provided with spring arms 33. The spring arms 33 extend in the Y-direction. At the free ends of the spring arms 33, projections 34 are formed. The spring arms 33 constituting one pair define a gap therebetween, the gap providing the similar function of the wire receiving incision 32. Each of the projections 34 projects towards the center of the gap and faces one another so that, when the drain wire 204 is received by the gap between the pair of spring arms 33, the projections 34 are brought into contact with the drain wire 204 and hold it. Thus, reliable electrical contact between the drain wire 204 and the ground plate 30 can be established.

As shown in FIGS. 13 and 14, the wire receiving portions 26 communicate with an upper opening 27 formed in the upper surface of the first insulator 20. The upper opening 27 has a rectangular shape, as shown in FIGS. 4 and 5. The upper opening 27 also communicates with the plate accommodation slit 21, as shown in FIG. 10. The upper opening 27 provides an advantage concerning the fabrication of the cable connector 100, wherein the advantage is that the connections between the drain wires 204 and the ground plate 30 can be established easily in the upper opening 27. The upper opening 27 further communicates with the separator accommodation slits 22. The communication provides another advantage concerning the fabrication of the cable connector 100, the advantage being described afterwards.

In the lower surface of the first insulator 20, a lower opening 28 is formed, as shown in FIGS. 13 and 14. The lower opening 28 is similar structure to the upper opening 27 but does not directly communicate with the wire receiving portion 26. The advantage of the lower opening 28 is also described afterwards, in connection with the further advantage of the upper opening 29.

As shown in FIG. 3, the second module 50 comprises a second insulator 60. The second insulator 60 has a second front end 60*a* and a second rear end 60*b* opposite to the second front end 60*a* in the Y-direction and is comprised of a main portion 61 and two arm portions 61*a*. The arm portions 61*a* are formed integral with the opposite sides of the main portion 61 in the X-direction and project from the main portion 61*a* in the Y-direction. The rear ends of the arm portions 61*b* constitute the second rear end 60*b* of the second insulator 60. The second rear end 60*b* faces the first front end 20*a* when the first and the second modules 10, 50 are combined with each other. The main portion 61 and the arm portions 61*b* define a hollow portion 61*b*.

The rear ends of the arm portions 61*b* are formed with projections 63, which project in the Y-direction. Under the combined state of the first and the second modules 10, 50, the projections 63 are fitted into the holes 23 of the first insulator 20, as shown in FIGS. 5 and 15. The projections 63 and the holes 23 are sized to be tightly fitted with each other.

Figure 8:
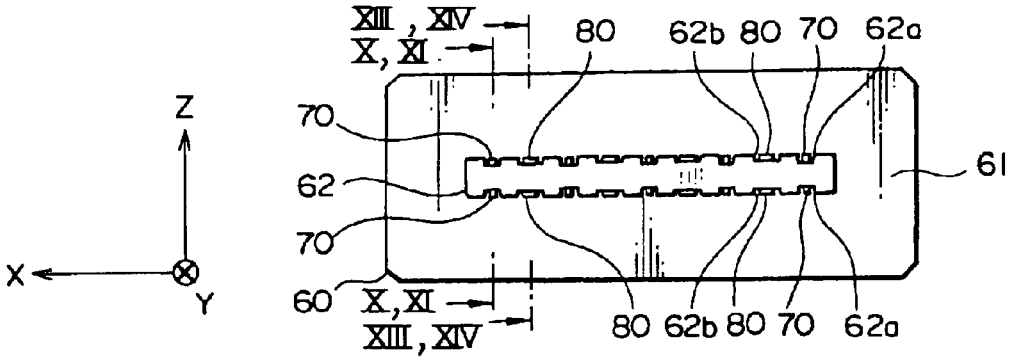
FIG. 8 is a front view showing the cable connector of FIG. 1.

The second insulator 60 is provided with a plate-like portion 62, as shown in FIGS. 3, 10 and 13. The plate-like portion 62 extends in the X- and the Y-directions and is positioned at the center of the main portion 61 in the Z-direction, as shown in FIGS. 3, 4 and 8. The plate-like portion 62 is smaller than the main portion 61 in the X-direction. The plate-like portion 62 projects from the second front end 60*a* of the second insulator 60, as shown in FIG. 3.

The plate-like portion 62 has upper and lower surfaces, in each of which two types of grooves 62*a*, 62*b* are formed, as shown in FIGS. 4 and 8. The grooves 62*a* and the grooves 62*b* extend in the Y-direction and are arranged alternately in the X-direction. Each two grooves 62*a* arranged on the upper and the lower surfaces of the plate-like portion 62 constitute one pair. The grooves 62*a* constituting one pair are positioned on one and the same YZ plane. Similarly, each two grooves 62*b* arranged on the upper and the lower surfaces of the plate-like portion 62 constitute one pair. The grooves 62*b* constituting one pair are positioned on one and the same YZ plane. The grooves 62*b* continue to holes 61*d* formed in the main portion 61 to continue to the hollow portion 61*b*, as shown in FIG. 13. The grooves 62*a* continue to slits 61*c*, respectively, which are formed in the main portion 61 and continue to the hollow portion 61*b*, as shown in FIGS. 10 and 11.

Into the grooves 62*b*, signal contacts 80 are fitted, respectively, as shown in FIGS. 5 and 8. The signal contacts 80 are strip conductors and also project in the hollow portion 61*b*, as shown in FIGS. 5, 13 and 14. Into the grooves 62*a*, ground contacts 70 are fitted, respectively, as shown in FIGS. 5 and 8. Because of the arrangement of the grooves 62*a*, 62*b*, one pair of the signal contacts 80 is positioned between the neighboring pairs of the ground contacts 70. The ground contacts 70 are connected to separators 90, respectively, which are fitted within the respective slits 61*c*, as shown in FIGS. 10 and 11. In this embodiment, each of the separators 90 is formed integral with the corresponding pair of the ground contacts 70, as shown in FIGS. 4, 10 and 11.

In detail, each of the separators 90 comprises first to third portions 91 to 93, as shown in FIGS. 4, 10 and 11. The first portion 91 is fitted into the corresponding slit 61*c*, while the second and the third portions 92, 93 project from the main portion 61 of the second insulator 60 in the Y-direction. The second portion 92 is positioned in the hollow portion 61*c*, while the third portion 93 further projects from the second rear end 60*b* of the second insulator 60, as can be seen in FIGS. 3, 5 and 11. In this embodiment, the second portion 92 is smaller than the first and the third portions 91, 93 in the Z-direction, as shown in FIGS. 10 and 11.

The first portion 91 is formed with an incision 94, as shown in FIGS. 4, 10 and 11. The incision 94 extends in the Y-direction. A small part of the incision 94 further extends in the second portion 92. Into the incision 94, the plate-like portion 62 is fitted at a position of the groove 62*a*. Between the neighboring ones of the separators 90, the corresponding pair of the signal contacts 80 projecting from the main portion 61 is positioned, as shown in FIGS. 5 and 11 so that each pair of the signal contacts 80 is electrically shielded from the other pairs of the signal contacts 80 by the corresponding separators 90.

Figure 12:
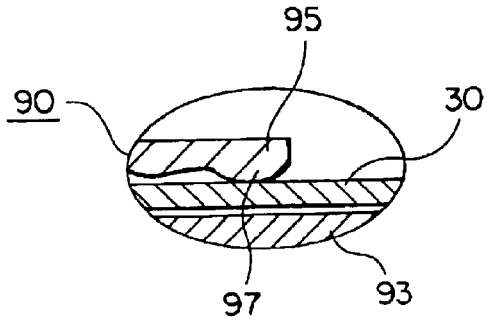
FIG. 12 is an enlarged view of a part of FIG. 10 which is indicated with a broken line XII.

The third portion 93 is formed with a pair of short arms 95 with engaging gaps 96 between the first portion 93 and the short arms 95. The arms 95 extend rearward along the upper and lower sides in the Y-direction so that the engaging gaps 96 also extend in the Y-direction. In this embodiment, projections 97 are formed at the free ends of the arms 95 projecting into the gaps, as shown in FIG. 12.

In connecting or mounting the cable connector onto ends of the plurality of balanced transmission cables 200, first module 10 is connected to the ends of the cables 200. Each of the balanced transmission cable 200 is treated to strip off the braded electrical shields 203 at its end portion to expose an end portion of the pair of the signal conductors 201 with the insulating member 202, and then is treated to partially remove the insulating member 202 to expose the conductors 201 at the end of the cable 200, as shown in FIG. 4. Then, the end portion of the cable 200 is inserted into the cable receiving portion 24 in the first insulator 20 of the first module 10 so that the conductors 201 project through the positioning holes 25 frontward from the first front end 20*a* of the first insulator 20 while the drain wire 204 is soldered to the ground plate 30. Thereafter, signal contacts 80 are fixedly connected or soldered to the corresponding signal conductors 201. Then the separators 90 are inserted into the corresponding separator accommodation slits 22 in the first insulator 20. Thereafter, the signal conductors 80 and the separator 90 are inserted into the holes 61*d* and slits 61*c* in the second insulator 60. Eventually, the signal conductors 80 and frond conductors 70 are fitted into the corresponding signal contact fitting slits 62*b* and ground contact fitting slits 62*a*, respectively, as shown in FIGS. 10, 11, 13 and 14. The projections 63 of the second insulator 60 are fitted into the corresponding holes 23 in the first insulator 20. Thus, connection of the cable connector 100 and the cables 200 are completed, as shown in FIG. 1.

Under the combined state of the first and the second modules 10, 50, the third portions 93 of the separators 90 are fitted into the respective separator accommodation slits 22. Upon fitting the separators 90 into the respective separator accommodation slits 22, the ground plates 30 are fitted into the engaging gaps 96 of the separators 90, while the separators 90 are fitted into the engaging incisions 31 of the ground plates 30 so that cross slit connections are established between the separators 90 and the engaging incisions 31. Especially, upon the connections, the projections 97 of the arms 95 are brought into contact with the ground plates 30 so that the separators 90 and the ground contacts 30 are electrically connected to each other, as shown in FIG. 12. The electrical connections can be easily checked because the connection points are exposed through the upper and the lower openings 27, 28 of the first insulator 20.

Figure 17:
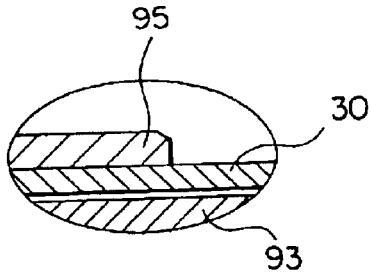
FIG. 17 is an enlarged view of a part of a modification of the cable connector, this figure corresponding to FIG. 12.

To keep the electrical connection, the arms 95 may be soldered on the ground plates 30. In case of the soldering connection, the arm 95 may have simple straight shape without the projection 97, as shown in FIG. 17.

In addition, the separators 90 and the ground plates 30 form enclosures in the first insulator 20. The enclosures serve to surround the end portions of the respective balanced transmission cables 200. In practical use, the enclosures surround the stripped insulating members 202 of the balanced transmission cables 200 so that each of the enclosures can provide the similar function of the electrical shield 203 of the balanced transmission cable 200, as shown in FIGS. 13 and 15. In other words, the lengths of the third portions 93 of the separators 90 in the Y-direction and the lengths of the ground plates 30 in the Y-direction are sized in consideration of the lengths of the stripped insulating member 202 of the balanced transmission cables 200.

In this embodiment, the positions of the signal contacts 80 in the Z-direction and the X-direction correspond to the positioning holes 25 of the first insulator 20. In detail, the imaginary extension of the surface of the signal contact 80 in the Y-direction is tangent to the positioning hole 25, as shown in FIG. 13. Therefore, the signal conductor 201 can be in contact with the signal contact 80 when the signal conductor 201 is inserted into the positioning hole 25 and when the first and the second modules 10, 50 are combined with each other. The soldering process may not be necessary for the connection between the signal conductor 201 and the signal contact 80. The positions of the signal contacts 80 and/or the shape of the signal contacts 80 may be changed. However, it is preferable to meet the condition that the connection between the signal conductor 201 and the signal contact 80 is suitably established without the soldering process.

What is claimed is:

1. A cable connector (100) connectable to at least two balanced transmission cables (200) each of which comprises a pair of signal conductors (201) insulated from each other, and an electrical shield (203) electrically insulated from and surrounding the pair of signal conductors (201), wherein:

the cable connector (100) comprises a first module (10) and a second module (50) which is combined with the first module (10); the first module (10) comprises a first insulator (20) and a ground portion (30) electrically connectable to the electrical shields (203), wherein: the first insulator (20) holds the ground portion (30) and is provided with separator accommodation slits (22); and the first insulator (20) is further provided with cable receiving portions (24) each of which is arranged between the respective neighboring separator accommodation slits (22) and is able to hold one of the balanced transmission cables (200); and the second module (50) comprises at least two pairs of signal contacts (80) connectable to the respective pairs of the signal conductors (201), ground contacts (70) insulated from the signal contacts (80), separators (90) physically and electrically connected to the ground contacts (70), and a second insulator (60) holding the ground contacts (70) and the signal contacts (80), wherein: the separators (90) project from the second insulator (60); and, under a combined state of the first and the second modules (10, 50), the separators (90) are fitted into the respective separator accommodation slits (22) and are electrically connected to the ground portion (30).

2. The cable connector (100) according to claim 1, wherein: the ground contacts (70) and the signal contacts (80) extend in the first direction; and each of the signal contacts (80) is arranged between the respective neighboring ground contacts (70) in the second direction.

3. The cable connector according to claim 1, wherein: the first insulator (20) has a first front end (20*a*) and a first rear end (20*b*) in a first direction; each of the cable receiving portions (24) extends in the first direction from the first rear end (20*b*) towards the first front end (20*a*) and is provided with a pair of positioning holes (25) which are formed in the first front end (20*a*) and serve to position the corresponding pair of signal conductors (201); and the signal contacts (80) are arranged in correspondence with the respective positioning holes (25).

4. The cable connector (100) according to claim 3, wherein: each of the pairs of the positioning holes (25) are arranged on one and the same imaginary plane extending in the first and the third directions; the signal contacts (80) constituting one pair are arranged in line with the third direction; and each pair of the signal contacts (80) is arranged between two pairs of the ground contacts (70) in the second direction.

5. The cable connector (100) according to claim 1, wherein: the ground portion (30) is comprised of at least two ground plates (30) spaced from each other; each of the separator accommodation slits (22) is laid on a plane intersecting the ground plates (30), each of the cable receiving portions (24) is arranged between the ground plates (30); under the combined state, the separators (90) and the ground plates (30) define enclosures for surrounding end portions of the respective balanced transmission cables (200).

6. The cable connector (100) according to claim 5, wherein: the ground plates (30) each extends in the first direction and in a second direction perpendicular to the first direction and are spaced from each other in a third direction perpendicular to the first and the second directions; the separator accommodation slits (22) are aligned in parallel to each other in the first direction and arranged in line with the second direction; each of the separator accommodation slits (22) is laid on the plane perpendicular to the second direction; the second insulator (60) has a second front end (60*a*) and a second rear end (60*b*) which faces the first front end (20*a*) under the combined state; and the separators (90) project from the second rear end (60*b*) and extend in the first and the third direction.

7. The cable connector (100) according to claim 5, wherein: each of the separators (90) is formed with pair of arms (95) extending in the first direction; the arms (95) and the separators (90) form engaging gaps (96); each of the ground plates (30) is formed with engaging incisions (31); and, under the combined state, the separators (90) are fitted into the respective engaging incisions (31), while the ground plates (30) are fitted into the respective engaging gaps (96).

8. The cable connector (100) according to claim 5, each of the balanced transmission cables (200) further comprising a drain wire (204) connected to the electrical shield (203), wherein at least one of the ground plates (30) is formed with wire receiving incisions (32) for receiving the respective drain wires (204) so that the ground plate (30) is electrically connected to the electrical shields (203).

* * * * *